US006536087B2

(12) United States Patent
Stüttem

(10) Patent No.: US 6,536,087 B2
(45) Date of Patent: Mar. 25, 2003

(54) METHOD AND APPARATUS FOR CONTINUOUSLY UNWINDING AND PROCESSING A YARN

(75) Inventor: Manfred Stüttem, Kürten (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/828,720

(22) Filed: Apr. 9, 2001

(65) Prior Publication Data

US 2001/0037545 A1 Nov. 8, 2001

Related U.S. Application Data

(63) Continuation of application No. PCT/EP99/07291, filed on Oct. 1, 1999.

(30) Foreign Application Priority Data

Oct. 9, 1998 (DE) ..... 198 46 484
Nov. 16, 1998 (DE) ..... 198 52 745

(51) Int. Cl.[7] ..... D02G 1/00
(52) U.S. Cl. ..... 28/248
(58) Field of Search ..... 66/125 R; 28/185, 28/186, 187, 248; 57/264, 265, 281; 226/11; 242/413, 413.1

(56) References Cited

U.S. PATENT DOCUMENTS 4,964,442 A * 10/1990 Tacq et al. ..... 139/452
4,998,567 A * 3/1991 Shaw ..... 139/116.2
5,018,390 A * 5/1991 Muller ..... 28/187
5,137,059 A 8/1992 Baeck et al.
5,440,870 A 8/1995 Neumann
5,544,679 A 8/1996 Tacq
5,644,908 A 7/1997 Schippers et al.

FOREIGN PATENT DOCUMENTS

| | | |
|---|---|---|
| DE | 905 312 A | 2/1987 |
| EP | 0 454 199 A1 | 10/1991 |
| EP | 0 495 446 A1 | 7/1992 |
| EP | 0 641 877 A2 | 3/1995 |
| EP | 0 656 437 A1 | 6/1995 |
| EP | 0 854 107 A1 | 7/1998 |
| FR | 2 527 661 A1 | 12/1983 |

* cited by examiner

*Primary Examiner*—Danny Worrell
(74) *Attorney, Agent, or Firm*—Alston & Bird LLP

(57) ABSTRACT

A method and an apparatus for continuously unwinding a yarn from a yarn package which may be associated with a method and apparatus for texturing the withdrawn yarn. The yarn is withdrawn from a feed yarn package supported in a creel, and the trailing yarn end of the feed yarn package connects to a leading yarn end of a second feed yarn package (reserve package) by a knot-type piecing to achieve a continuous advance of the yarn for its treatment or processing. A sensor is provided which detects and signals the yarn change from the feed yarn package to the reserve package after the feed yarn package is unwound, and the signal may be used to control the texturing process.

33 Claims, 4 Drawing Sheets

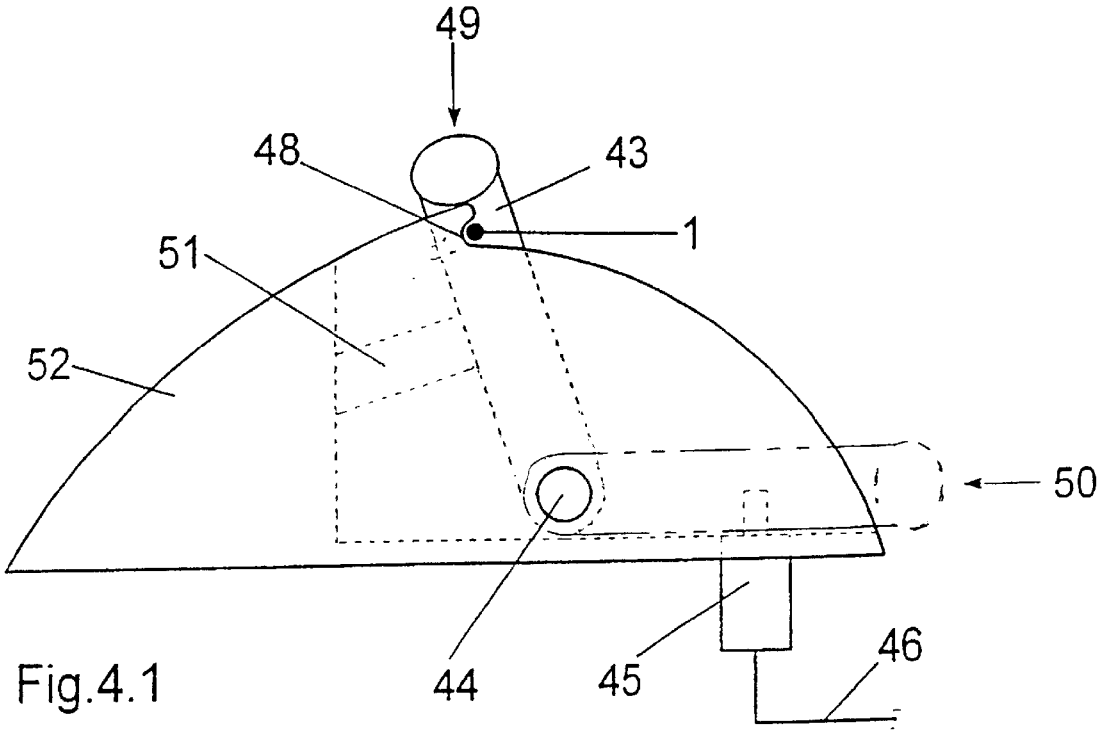
Fig.4.1
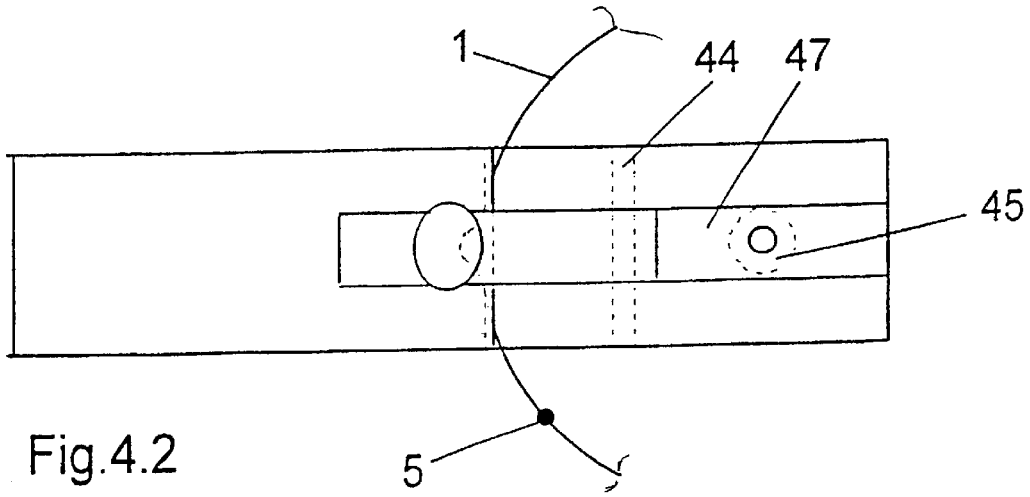
Fig.4.2

METHOD AND APPARATUS FOR CONTINUOUSLY UNWINDING AND PROCESSING A YARN

CROSS REFERENCE TO RELATED APPLICATION

This is a continuation of international application PCT/EP99/07291, filed Oct. 1, 1999, and designating the U.S.

BACKGROUND OF THE INVENTION

The invention relates to a method and an apparatus for continuously unwinding a yarn from a feed yarn package, as well as a method and a texturing machine for texturing a synthetic multifilament yarn.

Various methods and apparatus for unwinding a yarn are known and used in textile machines, wherein a yarn is withdrawn from a feed yarn package and treated or processed. In so doing, the yarn is continuously unwound from the feed yarn package, and advanced to the subsequent process. To ensure a continuous process sequence, the trailing yarn end of the feed yarn package is knotted to the leading yarn end of a second feed yarn package, which is referred to as a reserve package in the present application. Thus, after unwinding the feed yarn package, an automatic change occurs to the reserve package, whose trailing yarn end is in turn knotted to a leading yarn end of a further package, so that the process operates continuously. However, in the subsequent treatment or processing of the yarn, the knot-type piecings constitute problem spots, which may lead to defects in the finished product. In the extreme case, the piecing may separate, so that a yarn break results.

In the texturing of a yarn, the yarn undergoes an intensive treatment during processing. In this process, a crimped yarn is produced from a flat yarn. To this end, as is known, for example from EP 0 641 877 and corresponding U.S. Pat. No. 5,644,908, the yarn is twisted and, for purposes of setting, it is heat treated in its twisted condition. In so doing, the piecing between a trailing yarn end of a feed yarn package and a leading yarn end of a second feed yarn package (reserve package) influences the twist distribution, which results in an irregular crimp. In the further processing of the crimped yarn, such defects may lead, for example, to dye imperfections.

It is therefore an object of the invention to provide a method and an apparatus of the initially described kind for continuously unwinding a yarn, which ensure that a yarn of uniform quality is supplied to a subsequent process.

A further object of the invention is to make available a method and a texturing machine for texturing a synthetic yarn, for purposes of producing from predetermined feed yarn packages with a flat yarn defined packages with crimped yarn, which can be associated to the feed yarn package.

SUMMARY OF THE INVENTION

The above and other objects and advantages of the invention are achieved by the provision of a method and apparatus wherein the yarn is serially withdrawn from the feed yarn package and the yarn reserve package so that the withdrawn yarn is transferred from the yarn feed package to the yarn reserve package. Also, a sensor is provided which senses when the withdrawn yarn is transferred from the feed yarn package to the yarn reserve package, and the sensor then generates a responsive signal.

The invention distinguishes itself in that after unwinding the complete feed yarn package, a signal is generated. This indicates, for example, to an operator that a change of the feed yarn is imminent in the treatment or processing operation. Thus, there exists a correspondence between the finished or end product and the feed yarn package. The operator is able to initiate measures for purposes of avoiding possible occurrences of defects because of the knot-type piecing in the yarn. To detect a change from the feed yarn package to the reserve package, a sensor is used which indicates the transition of yarn from the feed yarn package to the reserve package (yarn change) by emitting a signal. To this end, it is basically possible to use three different embodiments of the method according to the invention. In a first embodiment of the method, the yarn continuously advances through the sensor. To this end, the sensor is designed and constructed such that it generates a signal, when a knot-type piecing passes by, which represents the trailing yarn end of the feed yarn package and the leading yarn end of the reserve package. This embodiment of the method has the advantage that the yarn can be scanned independently of the location in any location along the machine. Likewise, it is possible to use a device of the subsequent process, which detects a process parameter, for example, a yarn tension. In this process, the discontinuity of the signal of the device is evaluated for indicating the passage of the piecing.

In a further advantageous embodiment of the method, only a partial length of the yarn, which comprises a yarn length at the trailing end of the feed yarn package and a yarn length at the leading yarn end of the reserve package, advances through the sensor. To this end, the sensor is arranged between the feed yarn package and the reserve package. Since during the unwinding of the feed yarn package, the trailing yarn end of the feed yarn package and the leading yarn end of the reserve package extend in a loop loosely between the two packages, this variant of the method provides a possibility of scanning the yarn only directly before the yarn change. This minimizes the influence of scanning on the yarn.

A particularly simple and effective development of the invention is given by the further embodiment wherein the trailing yarn end of the feed yarn package and the leading yarn end of the reserve package are stopped, while unwinding the feed yarn package. It is thereby possible to use the movement of a yarn length in the region for signaling the yarn change. This embodiment of the method is characterized in particular in that it requires simple apparatus components for carrying out the method. To this end, the yarn length may be inserted, for example, in a sensor, which generates a signal, as soon as the yarn length no longer contacts it.

At this point, it should be mentioned that the method can be carried out using a variety of designs for the sensor. Thus, for example, it is possible to use mechanical, optical, or capacitive sensors, which generate an electrical, mechanical, or pneumatic signal.

To alert an operator of the signal, it is further proposed that the signal activates a signaler for a visual or acoustic display.

In a particularly advantageous further development of the invention, the signal is supplied to a control unit of the process for purposes of preparing or initiating an intervention in the process. This embodiment of the method is of advantage in particular in the case of automatic process sequences. Thus, it can be realized that, for example, the empty feed yarn package is replaced with a new package, the leading yarn end of which is knotted to the trailing yarn end of the reserve package. With that, it is likewise possible to document the yarn change, in that, for example, the position and the time are registered and stored. These data may form the basis for a further evaluation in quality management.

In processes wherein the piecing leads to occurrences of defects, or wherein it is necessary to maintain a correspondence between the feed yarn and the finished or end product, the embodiment of the method will be especially advantageous, wherein in the event of an unanswered signal, the process will be interrupted for a period of time. For example, in a texturing process, a flat feed yarn is textured in the process and subsequently wound as a textured or crimped yarn on a package. In machines of this kind, a plurality of end packages are wound with a crimped yarn from one feed yarn package. To this end, it is necessary that a package doff be performed in the takeup. During the package doff, a suction device removes the processed yarn to waste. The invention makes it now possible to initiate in such machines a package doff in the takeup in a purposeful manner. The special advantage lies in that it is possible to remove as waste the partial length of the yarn that contains the piecing.

A further advantageous development of the invention provides that in the subsequent process a monitoring mechanism is activated, which detects certain quality parameters for maintaining a uniform quality. With that, it is possible to initiate a process change or process interruption in the case of an unacceptable variation of the quality parameter, for example, the yarn tension. It is possible to detect as quality parameters, process parameters, such as, for example, yarn speed, yarn tension, or product parameters, such as, for example, yarn temperature.

To ensure a correspondence between the yarn of the feed package and the respective product, an embodiment of the invention is especially advantageous, wherein a controller causes a change of the feed yarn package and a registration of the new feed yarn package, when a signal is received. To this end, it is possible to activate, for example, a transfer device, which selects a feed yarn package with a certain yarn and supplies it to the position vacated by the unwound feed yarn package. Thus, there exists the possibility of not only coordinating the feed yarn and end product, but also of correlating material-specific occurrences in the process back to the respective initial product. However, the new feed yarn package may also be registered by manually inputting identifications of the respective feed yarn package. Advantageously, the registration remains stored inside the controller, until the replaced feed yarn package is unwound as a result of the yarn change.

It is preferred to use the invention in processes, wherein a yarn is treated, which subsequently results in an end product in a further processing operation. This enables a method of texturing a multifilament synthetic yarn, wherein the produced package can be exactly specified as regards its starting material by reference to the feed yarn package. Thus, the method of the invention distinguishes itself in particular in that it permits producing packages with crimped yarn, which hold from the start to the end, a yarn of a uniformly high quality. Defects by knot-type piecings may be treated individually. In the case that monitoring of a quality parameter results in no unacceptable variation of the quality parameter caused by the piecing, the package will be produced without interruption. When a limit value of the quality parameter is exceeded, or in general, when a yarn change signal is waiting, winding of the crimped yarn may be interrupted, for example, by automatically doffing the package.

In the texturing of synthetic yarns, machines are used, wherein a plurality of processing stations are arranged in tiers side by side. With the use of such machines, it is possible to use in a very advantageous manner an embodiment of the method wherein each takeup device is associated to two creel positions, which accommodate the feed yarn package and the reserve package. The registrations of the feed yarn package and reserve package are linked to the respective creel positions and stored in the control system, so that based on the currently active creel position, the produced package can be exactly specified as regards the starting material.

The method of the present invention renders it possible to specify the piecing in the yarn by a winding time and a yarn length, which may be attached to the package as a data printout.

In the case where a plurality of packages are produced from one feed yarn package, it is preferred to use the embodiment wherein each package which has been wound from one feed yarn package receives an identification. When a yarn change is signaled, the identification will be changed for subsequent packages, since same are produced from a different feed yarn. With that, it is possible to trace the crimped yarn back to the spinning process in which the flat yarn was produced.

A further categorization of produced packages can be realized in that the package containing the yarn change and, thus, the piecing receives an additional identification. Such a categorization is especially advantageous to distinguish in weaving between warp yarn and weft yarn packages.

The identification may occur in a simple manner by a numbering that is restarted after each yarn change.

For carrying out the method of the present invention, an apparatus is provided which facilitates successive processing of even different yarns in one process without a major interruption. To this end, a sensor is provided that detects and signals the change of the yarn from the feed yarn package to the yarn of the reserve package.

To arrange the sensor in the apparatus for scanning the yarn, at least two different embodiments of the apparatus according to the invention are possible, which are dependent on the type of sensor. Especially preferred is the embodiment which employs a sensor that scans the yarn continuously. Also, it is possible to arrange the sensor between the feed yarn package and the reserve package. In such instance, the yarn length that is formed by the trailing end of the feed yarn package and the leading end of the reserve package and remains in a loop between the packages, is scanned in a simple manner in that the sensor detects the movement of the yarn length.

To be able to initiate corresponding measures during the yarn change, the sensor preferably connects to a signaling device.

In the case of automatically proceeding processes, the sensor is preferably connected to a controller which controls the proceeding processes.

The invention also provides for a texturing machine which provides a further solution to the underlying problem. Since in the texturing process, improvement of the yarn is possible only by a significant intervention in the structure of the yarn, it is necessary to treat separately in particular irregularities in the yarn, as are caused by a knot-type piecing. The texturing machine of the present invention makes it possible to texture and wind a yarn continuously and with a uniform quality irrespective of a change to the yarn of a reserve package, when the feed yarn package is unwound.

In this connection, it is preferred to use an embodiment of the texturing machine wherein the sensor is arranged between two creel positions, so that the connecting yarn length can be scanned. This permits a simple layout and arrangement of the sensor. Also, it is no longer necessary to scan the yarn continuously. Only in the case of the yarn change, will the yarn length which extends with the piecing between the two packages, be withdrawn. The movement of the yarn length is detected and signaled by the sensor.

Preferably, such sensors are designed and constructed as yarn detectors, wherein the yarn length is held in an inoperative position, and wherein the movement of the yarn length causes the yarn detector to move to a signaling position and generate a signal. The signaling can generated in a simple manner by means of a contact switch.

When sensors are used, which continuously scan the yarn optically or mechanically, it will be advantageous to position the sensor in the yarn path downstream of the creel and upstream of the first feed system.

Thus, it is proposed, among other things, to design and construct the sensor as a yarn tensiometer, which measures the tension on the advancing yarn and generates a signal, when a limit value of the yarn tension is exceeded. In this connection, one assumes that when the yarn changes from the feed yarn package to the reserve package, the unwinding behavior of the yarn varies for a short time and, thus, leads to a variation in the yarn tension. It is preferred to use this further development of the texturing machine in processes, wherein the actual piecing exerts no significant influence in the further processing of the crimped yarn. To that extent, a signal is generated only in the case of a deviation from a predetermined limit value of the yarn tension.

To alert an operator of a signal visually or acoustically, the sensor connects to a signaling device, which may be in form of a lamp or siren.

To be able to intervene in the process automatically, it is preferred to construct the texturing machine with the sensor connected to a controller which controls the operation of the machine.

In such machine, the controller comprises means for detecting, evaluating and outputting quality parameters and means for linking the quality parameters with signals that are dependent on the yarn change. The texturing machine of the present invention is thus suited to perform a continuous quality monitoring from the feed yarn package to the wound package, so as to make thus available a high-quality yarn for further processing.

BRIEF DESCRIPTION OF THE DRAWINGS

In the following, the methods and apparatus are described in greater detail with reference to the accompanying drawings, in which:

FIGS. 4.1 and 4.2 are schematic views of an embodiment of a yarn detector.

DETAILED DESCRIPTION OF THE PREFERRED EMBODIMENTS

Figure 1:
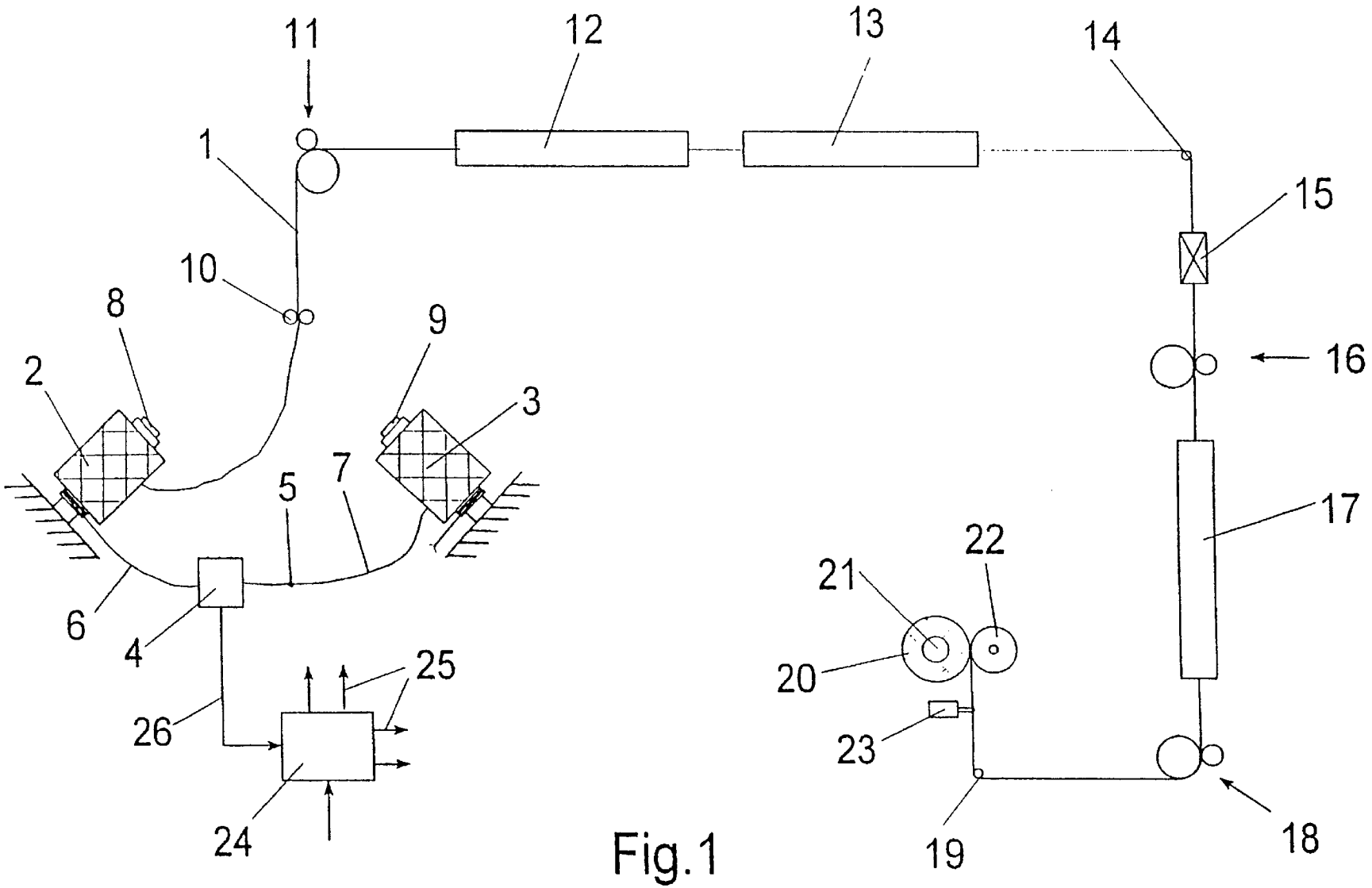
FIG. 1 is a schematic view of an embodiment of a false twist texturing machine with the apparatus of the present invention.

FIG. 1 illustrates a false twist texturing machine, which embodies the present invention. In this machine, a feed yarn package 2 is creeled in a feed position that includes a mandrel 8. From the feed yarn package 2, a yarn 1 is unwound by a first feed system 11. To this end, the yarn 1 is guided overhead from the feed yarn package 2 through a yarn guide 10. The feed system 11 advances the yarn into a false twist texturing zone. The false twist texturing zone comprises a heating device 12, a cooling device 13 downstream thereof in the path of the yarn, as well as a false twist unit 15. A second feed system 16 withdraws the yarn 1 from the false twist texturing zone and guides it into a second heating device 17 for an aftertreatment. At the outlet end of the second heating device 17, a further feed system is provided, which withdraws the yarn from the heating device 17 and advances it to a takeup device downstream thereof. The takeup device comprises a winding spindle 21, on which a package 20 is produced. The package 20 is driven by a drive roll 22 in contact therewith. A yarn traversing device 23 extends in the yarn path upstream of the package 20. The traversing device 23 includes an oscillating yarn guide, which reciprocates the yarn transversely to its direction of advance, so that a cross-wound package is produced.

Laterally next to the feed yarn package 2, a mandrel 9 of a second feed position holds a second feed yarn package, which is named reserve package 3 for purposes of distinguishing it. The feed yarn package 2 and reserve package 3 may be arranged, for example, in a creel, which accommodates a plurality of feed yarn packages for a plurality of processing stations in the texturing machine. A trailing yarn end 6 of feed yarn package 2 is knotted to a leading yarn end 7 of reserve package 3, so that a piecing 5 is formed in the yarn. The partial length of the yarn with the piecing 5 extends through a sensor 4 between the feed yarn package 2 and reserve package 3. The sensor 4 comprises a signaling line 26, which connects the sensor 4 to a controller 24. The controller 24 comprises a plurality of outputs 25 for controlling the process of the texturing machine.

In the textile machine shown in FIG. 1, the yarn 1 is continuously withdrawn from the feed yarn package 2 and textured in the false twist texturing zone. In this process, the false twist unit 15 imparts to the yarn 1 a false twist, which is set in heating device 12 and cooling device 13. The feed systems 11 and 16 are operated with a speed difference, so that the yarn undergoes simultaneously a drawing in the false twist texturing zone. After a shrinkage treatment in heating device 17, the yarn 1 is subsequently wound in the takeup device to a package 20. In such a process, the yarn from the feed yarn package 2 is successively wound to a plurality of packages 20. To this end, the controller 24 initiates a package doff in the takeup device each time after the end diameter of the packages is reached. While the package 20 is replaced with a new empty tube, the continuously advancing yarn 1 is delivered via a suction device into a waste container until the winding operation continues.

The yarn 1 is continuously advanced by feed system 11. Consequently, a change to the yarn of the reserve package 3 will occur after the yarn is unwound from feed yarn package 2. To this end, the trailing yarn end 6 of feed yarn package 2 and the leading yarn end 7 end of reserve package 3 are knotted to form a piecing 5. During the change from feed yarn package 2 to reserve package 3, the partial length of the yarn is now likewise withdrawn by feed system 11. Since the partial length of yarn is scanned in sensor 4, the sensor 4 detects the transition of the yarn from the feed yarn package 2 to the reserve package 3. To this end, the sensor may be designed and constructed such that the trailing yarn end 6 and leading yarn end 7 advance through the sensor 4, so that the sensor 4 registers the passage of piecing 5 and converts it into a signal. However, it is also possible to design the sensor such that is scans exclusively the movement of a yarn length at the trailing yarn end 6 or at the leading yarn end 7. The signal generated by the sensor 4 is supplied via signaling line 26 to the controller 24 to initiate a doff of the packages. With that, it is possible to avoid having the partial length of the yarn with the piecing 5 wound on a package. Furthermore, this permits associating the feed yarn package 2 to the packages wound from the yarn thereof. To this end, it is possible to identify the last package by labeling, a tie-off wind, or a simple visible marking.

However, it is also possible to wind the partial length of the yarn with piecing 5 on the packages. The package containing the piecing can then be marked likewise, so as to permit sorting the packages for final processing, for example by warp and weft materials.

The controller 24 can also be advantageously used for activating a monitoring system for purposefully observing occurrences of defects that are caused in the process by piecing 5. Likewise, it is possible to evaluate the quality parameters, such as, for example, yarn tension, yarn break, which occurred in the period of time, when the yarn from feed yarn package 2 was processed. With that it is possible to draw purposefully conclusions as to the quality of the yarn of the feed yarn package.

Furthermore, the controller 24 permits controlling of the loading of the creel. To this end, a new feed yarn package is inserted on mandrel 8 and the leading yarn end of the new feed yarn package is tied to the trailing yarn end of the reserve package with a knot.

Figure 2:
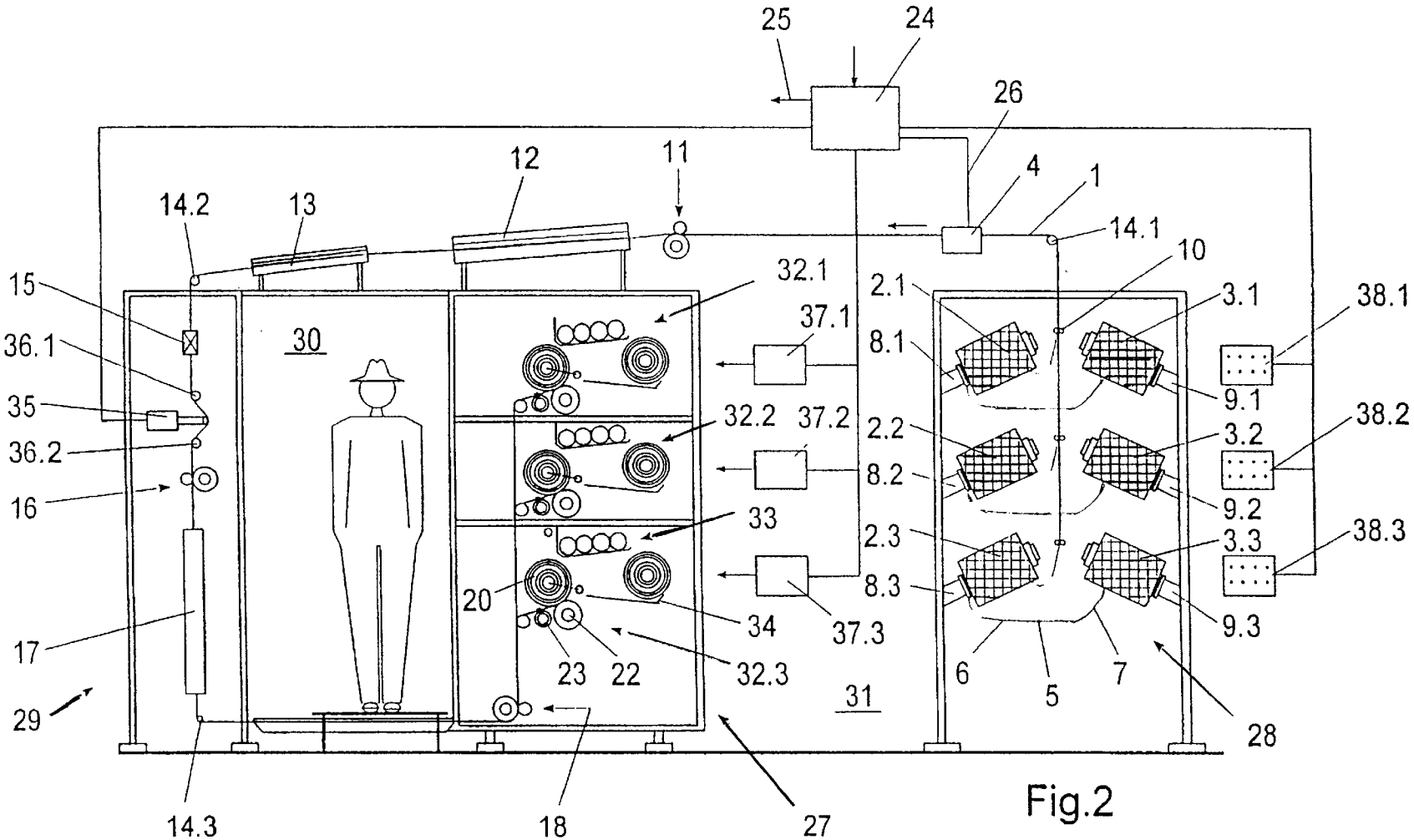
FIG. 2 is a schematic, cross sectional view of a texturing machine according to the invention.

The method of the present invention is depicted in FIG. 1 by way of example with reference to a texturing machine. However, the method of the invention may be applied to all known textile machines, wherein a yarn is continuously advanced from a feed yarn package to a treatment process. FIG. 2 shows an embodiment of a texturing machine according to the invention. In particular, FIG. 2 is a cross sectional view of one half of a false twist texturing machine. In the following description, structural parts with the same function are therefore indicated by identical numerals.

The texturing machine comprises a creel frame 28, a processing frame 29, and a takeup frame 27. A service aisle 30 extends between the takeup frame 27 and the processing frame 29. On the side of the takeup frame 27 opposite to the service aisle 30, the creel frame 28 is arranged at a distance from the takeup frame 27. Between the takeup frame 27 and the creel frame 28, a doff aisle 31 is provided for a doffer (not shown). The texturing machine comprises a plurality of processing stations, each of which processes one yarn 1. The processing stations are parallel to one another. The takeup devices occupy a width of three processing stations. Thus, three takeup devices 32.1, 32.2, and 32.3 overlie one another in tiers in the takeup frame 27.

Each takeup device 32.1, 32.2, and 32.3 is associated to two creel positions in the creel frame 28, which are formed by mandrels 8.1, 8.2, 8.3 and 9.1, 9.2, 9.3, which mount feed yarn packages 2.1, 2.2, 2.3 and 3.1, 3.2, 3.3. The feed yarn packages 2.1 and 3.1 are associated to takeup device 32.1, the feed yarn packages 2.2 and 3.2 to takeup device 32.2, and the feed yarn packages 2.3 and 3.3 to takeup device 32.3. In the following, the yarn advance is described with reference to one processing station. The trailing yarn ends 6 of feed yarn packages 2.1, 2.2, 2.3 from which the yarn 1 is just being unwound, are each joined to the leading yarn end 7 of a reserve package by a knot-type piecing 5.

In each processing station, a first feed system 11 withdraws the yarn 1 from feed yarn package over a yarn guide 10 and a yarn guide 14.1. Upstream of the feed system 11, a sensor 4 is arranged for continuously scanning the yarn 1. The sensor 4 connects via signaling line 26 to controller 24. When viewed in the direction of the advancing yarn, a first heating device 12, a cooling device 13, a false twist unit 15, and a second feed system 16 extend downstream of the first feed system 11. In the path of the yarn between false twist unit 15 and the second feed system 16, a yarn tension sensor 35 is provided, which the yarn enters via a yarn guide 36.1 and leaves via a yarn guide 36.2. The yarn tension sensor 35 connects to the controller 24.

A second heating device 17, a yarn guide 14.3, and a third feed system 18 extend between the takeup device 32.1, 32.2, 32.3 and the second feed system 16. Between the feed yarn package 2.1, 2.2, 2.3 and the takeup device 32.1, 32.2, 32.3, the yarn 1 advances through a plurality of yarn guides 14.1, 14.2, and 14.3. Preferably, these yarn guides are constructed as deflection rolls.

In the takeup device 32.1, 32.2, 32.3, the yarn is wound to a package 20. A drive roll 22 drives the package 20. Upstream of drive roll 22, a yarn traversing device 23 reciprocates the yarn 1 along package 20, thereby causing it to be wound in a cross wind.

The takeup device 32.1, 32.2, 32.3 comprises a package storage 34, which serves to receive full packages 20. To remove the full packages 20, a winding spindle is pivoted by means of a package support, and the full package is placed on a rollway. The rollway forms part of the package storage 34. On the rollway, the full package 20 waits for its removal. To simplify the removal, the rollway slopes toward the doff aisle 31. Furthermore, each takeup device 32 comprises a tube feed device 33.

Each takeup device 32.1, 32.2, 32.3 is controllable via a takeup control device 37.1, 37.2, and 37.3 which connects to controller 24.

On the creel frame 28, each processing station is associated to an input unit 38.1, 38.2, 38.3 that connects to controller 24.

In the situation of the texturing machine shown in FIG. 2, one yarn 1 is withdrawn from each of the feed yarn packages, textured in the false twisting zone, relaxed in the second heating device, and subsequently wound to a package 20. In this process, the yarn tension is continuously measured by yarn tension sensor 35 for monitoring its quality. The measured values are supplied to controller 24 for evaluation and process control.

After the feed yarn package 2 is fully unwound, a yarn change occurs to the second feed yarn package 3.1, 3.2, 3.3. As soon as the piecing 5 in yarn 1 passes the sensor 4, a signal is supplied to controller 24 via signaling line 26. The controller 24 is then able to initiate various control measures.

One possibility consists in influencing via the takeup control device 37.1, 37.2, 37.3 the respective takeup device 32.1, 32.2, 32.3 of the affected processing stations in such a manner that the package is doffed. In this event, the takeup operation is interrupted. The yarn is cut by means of an auxiliary device (not shown) and removed via a suction device. Subsequently, the package in the takeup device is replaced with a new tube. During the package doff, the yarn length with piecing 5 advances in the suction device to a waste container (not shown). When the winding operation restarts, the first package will thus be produced from the yarn of feed yarn package 3.1, 3.2. 3.3. In this process, the takeup control device 37.1, 37.2, 37.3 can simultaneously proceed with a continuous identification of the wound packages that are produced from the yarn of feed yarn package 3.1, 3.2, 3.3. The identification may include the processing station, a continuous numbering, as well as characteristic data of the feed yarn package. The characteristic data or the registration of the feed yarn package 2.1, 2.2, 2.3 or feed yarn package 3.1, 3.2, 3.3 is manually entered via input unit 38.1, 38.2, 38.3. In this process, an operator registers during the change of the feed yarn package the characteristic data thereof by means of the input unit and supplies it to controller 24. With that, the information about the feed yarn package or the yarn that is fed and processed, is available to each processing station.

A further possibility of intervening in the process consists in that the controller 24 influences the processing station via takeup control device 37.1, 37.2, 37.3 such that the package that contains the piecing is separately identified. Since a plurality of packages are produced from one feed yarn package, it is thus possible to effect a purposeful categorization.

Furthermore, the controller may include means, which monitor and evaluate the continuously supplied quality parameters—such as, for example, the yarn tension—upon receipt of a signal from sensor 4. This means, a package doff will be initiated only, when a predetermined limit value is exceeded. Likewise, it is possible to eliminate during the quality monitoring deviations caused by piecing 5, which will be of advantage in particular in the case of a long-term monitoring of yarn breaks.

In the arrangement shown in FIG. 2, the sensor 4 precedes, for example, the first feed system 11. The sensor 4 that contains optical or mechanical means to detect the piecing 5, may also be arranged in a different location in the yarn path.

The texturing device of the machine shown in FIG. 2, which comprises the false twist unit, the heater, and the cooling device, represents an example. It is also possible to texture the yarn by other means, for example, entanglement nozzles. The invention also covers such machines.

Figure 3:
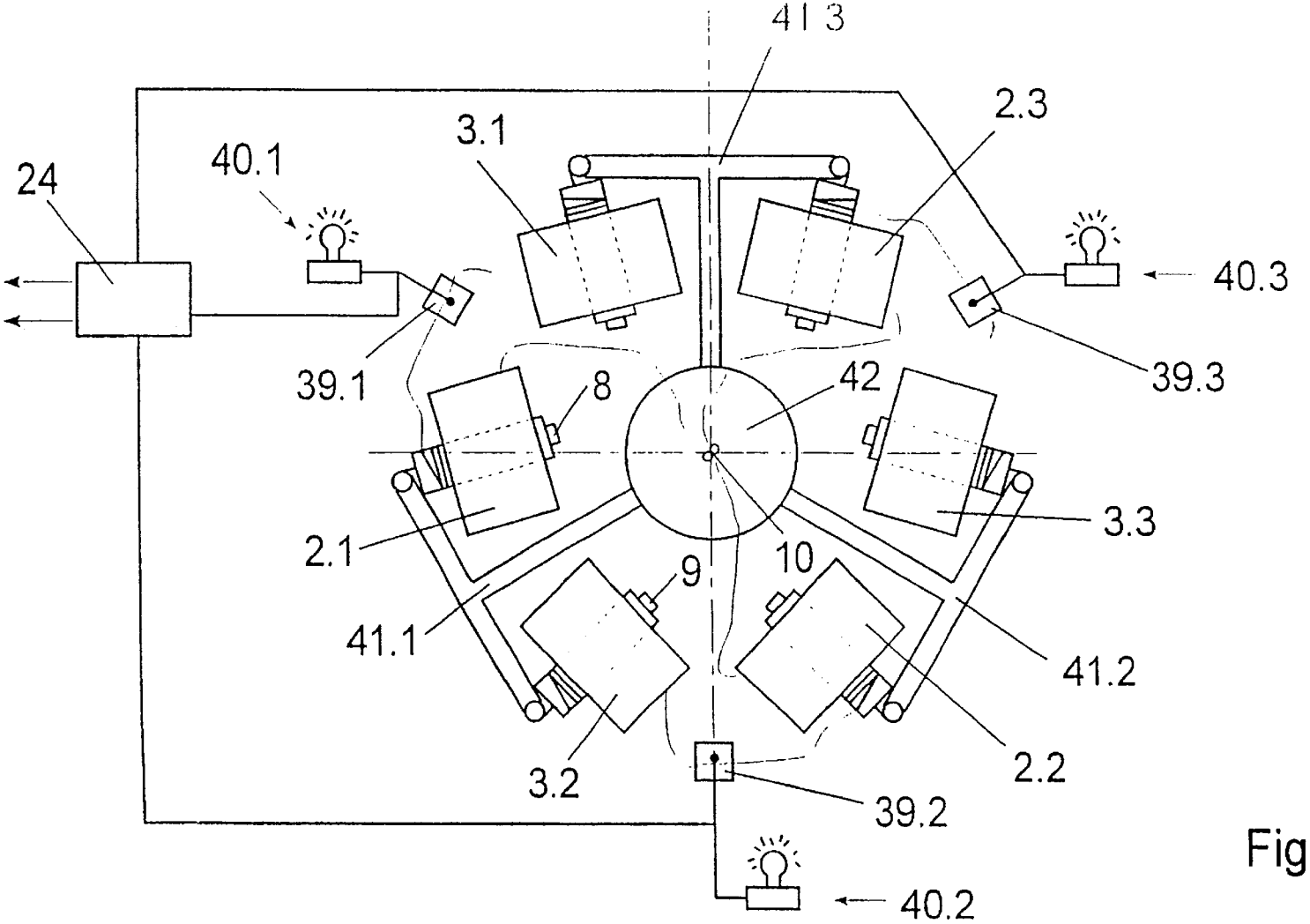
FIG. 3 is a schematic top view of a creel frame with feed yarn packages.

FIG. 3 illustrates a further embodiment of a creel frame, as could be used, for example, in a machine of FIG. 1 or FIG. 2. The creel frame comprises a rotatable axle 42, which mounts on its circumference, evenly distributed, three T-shaped supports 41.1. 41.2, and 41.3. Arranged on the free ends of the T-shaped support are mandrels 8 and 9, which each accommodate one feed yarn package. In an advantageous manner, the mandrels 8 and 9 may be pivotably connected to the support for pivoting thereabout. Each support 41.1, 41.2, 41.3 accommodates for one processing station a feed yarn package 2.1, 2.2, 2.3 and a reserve package 3.1, 3.2, 3.3, with adjacent feed yarn packages of adjacent T-shaped supports being associated to one processing station. In the case of this creel, the yarns 1 are withdrawn from their respective feed packages 2.1, 2.2, and 2.3 via a yarn guide 10 mounted in the center thereof. Arranged between the feed yarn package and the reserve package is a yarn detector 39.1, 39.2, 39.3, which operates as a sensor. The yarn detector receives a yarn length that is formed by the leading yarn end of the reserve package and the trailing yarn end of the feed yarn package. The yarn detector 39 connects to a signaling device 40.1, 40.2, 40.3, which is a lamp in the present embodiment. The yarn detector 39.1, 39.2, 39.3 connects likewise to a controller 24.

The arrangement shown in FIG. 3 causes the yarn detector 39.1, 39.2, 39.3 to be activated after the feed yarn package is unwound, as will be described below in greater detail. This activates the signaling device 40.1, 40.2, 40.3. The operator can now immediately recognize, which processing station is ready for a yarn change, or which processing station requires a new feed yarn package in the creel. The linkage to the controller 24 permits an immediate conversion to automatically proceeding measures in the subsequent process.

FIGS. 4.1 and 4.2 illustrate an embodiment of a yarn detector as could be used, for example, in the creel of FIG. 3.

FIG. 4.1 is a side view and FIG. 4.2 a top view of the yarn detector. The following description will therefore apply to both Figures. The yarn detector consists of a holder 52 and a movable yarn guide 43. The holder includes a groove 47. In the groove 47, the yarn guide 43 is pivotably mounted on an axle 44. The yarn guide is thus able to move between an idle position 49 and a signaling position 50. In the idle position 49, the yarn guide 43 that is designed and constructed as a bar, contacts in an upright position a stop 51. In this idle position 49, the yarn guide 43 extends through a guide notch 48 arranged in holder 52 on both sides of groove 47. The yarn 1 extends in guide notch 48, and the yarn guide 43 deflects and secures it at the same time. By a pivotal movement, the yarn guide 43 is able to reach from its idle position 49 a signaling position 50. In the signaling position 50, a contact switch 45 is arranged, which is activatable by the contact of yarn guide 43. The contact switch 45 connects via a signaling line 46 to a signaling device (not shown).

In the position of the yarn detector shown in FIGS. 4.1 and 4.2, the yarn 1 is clamped. The yarn length between the feed yarn package and the reserve package is at rest. When now a change of the yarn occurs from the feed yarn package to the reserve package, the yarn 1 is withdrawn from the yarn detector. This causes the yarn guide 43 to move away from stop 51 and to engage the signaling position. With that, the contact switch 45 is activated, so that a signal is generated. The described yarn detector is to be considered an example. However, the invention is not limited to individual embodiments of sensors, but basically covers all embodiments commonly known to the person of skill in the art, which make it possible to detect a knot-type piecing in the yarn and to generate a signal thereafter.

What is claimed is:

1. A method of continuously processing a yarn comprising the steps of:

providing a yarn feed package and a yarn reserve package, with the trailing end of the yarn feed package joined to the leading end of the yarn reserve package by a piecing, serially withdrawing the yarn from the yarn feed package and the yarn reserve package so that the withdrawn yarn is transferred from the yarn feed package to the yarn reserve package, sensing when the withdrawn yarn is transferred from the feed yarn package to the yarn reserve package and generating a responsive signal, subjecting the withdrawn yarn to a treatment process, and supplying the signal to a controller to cause a change in the treatment process and/or a change of the feed yarn package.

2. The method as defined in claim 1, wherein the sensing step includes continuously advancing the withdrawn yarn through a sensor, with the sensor detecting and signaling the piecing between the trailing yarn end of the feed yarn package and the leading yarn end of the reserve package.

3. The method as defined in claim 1, wherein a partial length of the yarn consisting of a yarn length at the trailing end of the feed yarn package and a yarn length at the leading end of the reserve package is guided through a sensor, with the sensor detecting and signaling the piecing between the trailing yarn end of the feed yarn package and the leading yarn end of the reserve package.

4. The method as defined in claim 1, wherein a length of the yarn from the trailing end of the feed yarn package or from the leading end of the reserve package is scanned by a sensor, with the sensor detecting and signaling the movement of the yarn length.

5. The method as defined in claim 4, wherein the yarn length is formed by the piecing between the trailing yarn end of the feed yarn package and the leading yarn end of the reserve package.

6. The method as defined in claim 1, wherein the controller acts in response to receiving a signal from the sensor to cause a change in the treatment process.

7. The method as defined in claim 6, wherein the treatment process comprises texturizing the withdrawn yarn.

8. The method as defined in claim 1, wherein the controller interrupts the process for a period of time, when a signal is received.

9. The method as defined in claim 1, wherein the controller causes a temporary monitoring of at least one quality parameter, and that in the event of unacceptable deviations of the quality parameter the process is changed or interrupted.

10. The method as defined in claim 9, wherein the quality parameter is a product parameter characterizing the produced yarn and/or a process parameter characterizing the course of the process.

11. The method as defined in claim 1, wherein the controller causes a change of the feed yarn package and a registration of the new feed yarn package.

12. The method as defined in claim 11, wherein the registration of the new feed yarn package is stored by the controller and associated to the treatment process, when a signal indicates the yarn change to the feed yarn package.

13. The method as defined in claim 1, wherein the yarn on the feed yarn package is fed as a flat yarn, textured in the treatment process, and wound as a textured yarn to a package.

14. A method of texturing a synthetic multifilament yarn, comprising the steps of providing a yarn feed package and a yarn reserve package, with the trailing end of the yarn feed package joined to the leading end of the yarn reserve package by a piecing, serially withdrawing the yarn from the yarn feed package and the yarn reserve package so that the withdrawn yarn is transferred from the yarn feed package to the yarn reserve package, sensing when the withdrawn yarn is transferred from the feed yarn package to the yarn reserve package and generating a responsive signal, texturing the withdrawn yarn, winding the textured yarn to form cross wound packages, and supplying the signal to a controller of the texturing process to cause a change in the process and/or a change of the feed yarn package.

15. The method as defined in claim 14, wherein the packages are produced in a takeup device which is associated to a feed position accommodating the feed yarn package and to a feed position accommodating the reserve package, and comprising the further step of registering the feed yarn package and the reserve package so as to be linked to the respective feed position.

16. The method as defined in claim 14, wherein upon signaling a yarn change from the feed yarn package to the reserve package, the package being wound during the yarn change receives an identification.

17. The method as defined in claim 14, wherein the feed yarn package includes a yarn length which is adequate for winding a plurality of produced packages, the produced packages being identified as related to a particular feed yarn package.

18. The method as defined in claim 17, wherein upon signaling the yarn change from the feed yarn package to a reserve package, the identification is changed for the subsequently produced packages.

19. The method as defined in claim 17, wherein the package being produced during the yarn change from the feed yarn package to the reserve package receives an additional identification.

20. The method as defined in claim 17, wherein the identification occurs by a numbering related to the feed yarn package.

21. An apparatus for continuously unwinding a yarn, comprising at least two feed positions, with one of the feed positions accommodating a feed yarn package and the other feed position a reserve package, conveying means for withdrawing the yarn from the feed yarn package and from the reserve package, and with the trailing end of the yarn from the feed yarn package being knotted to the leading end of the yarn from the reserve package, a sensor for detecting and signaling the transfer of the withdrawn yarn from the feed yarn package to the reserve package, and a controller for causing a change in a subsequent treatment process and/or a change of the feed yarn package responsive to a signal from the sensor.

22. The apparatus as defined in claim 21, wherein the sensor is arranged in the yarn path upstream of the conveying means and downstream of the feed positions, so that the advancing yarn can be continuously scanned by the sensor.

23. The apparatus as defined in claim 21, wherein the sensor is arranged between the two feed positions, so that the yarn length from the trailing yarn end of the feed yarn package and the leading yarn end of the reserve package can be scanned.

24. The apparatus as defined in claim 21, wherein the sensor is connected to a signaling device.

25. The apparatus as defined in claim 21, further comprising a processing apparatus for processing the withdrawn yarn in the subsequent treatment process, and wherein the controller controls the processing apparatus.

26. A texturing machine for texturing and winding a yarn comprising at least two feed positions for mounting a feed yarn package and a reserve package, and wherein a trailing yarn end of the feed yarn package is knotted to a leading yarn end of the reserve package, at least one yarn feed system positioned for alternately withdrawing the yarn from the feed positions, and advancing the withdrawn yarn along a path of travel leading to a takeup device for forming yarn packages, a texturing device positioned along the yarn path of travel for imparting crimp to the advancing withdrawn yarn, a sensor for detecting and signaling the transfer of the yarn from the feed yarn package to the reserve package, and a controller for causing a change in the texturing device and/or a change of the feed yarn package responsive to a signal from the sensor.

27. A texturing machine as defined in claim 26, wherein the sensor is arranged between the two feed positions, so that the yarn length from the trailing yarn end of the feed yarn package and the leading yarn end of the reserve package can be scanned.

28. A texturing machine as defined in claim 27, wherein the sensor is designed and constructed as a yarn detector, which holds a yarn length in an idle position, and which reaches a signaling position by the movement of the yarn length and generates a signal in the signaling position.

29. A texturing machine as defined in claim 28, wherein the yarn detector comprises a movable yarn guide and a contact switch, the contact switch being activated for generating a signal by the movement of yarn guide from its idle position to its signaling position.

30. A texturing machine as defined in claim 26, wherein the at least one yarn feed system includes a first feed system positioned between the two feed positions and the texturing device, and wherein the sensor is arranged in the path of the yarn downstream of the two feed positions and upstream or downstream of the first feed system, so that the advancing yarn can be continuously scanned.

31. A texturing machine as defined in claim 30, wherein the sensor is designed and constructed as a yarn tensiometer, which measures the tension of the advancing yarn, and which generates a signal when a limit value of the yarn tension is exceeded.

32. The texturing machine as defined in claim 26, wherein the controller controls the operation of the texturing device.

33. The texturing machine as defined in claim 26, wherein the controller comprises means for detecting, evaluating, and outputting quality parameters and means for linking the quality parameters to the signals dependent on the yarn change.

* * * * *